US007534355B2

(12) United States Patent
Lockerman et al.

(10) Patent No.: US 7,534,355 B2
(45) Date of Patent: May 19, 2009

(54) STORM DRAIN FILTER WITH VARIABLE FLOW CAPACITY

(75) Inventors: Tony Mason Lockerman, Raleigh, NC (US); Houston Linwood Crumpler, Roseboro, NC (US); John Mills Crumpler, Raleigh, NC (US)

(73) Assignee: Trash Guard Incorporated, Roseboro, NC (US)

( * ) Notice: Subject to any disclaimer, the term of this patent is extended or adjusted under 35 U.S.C. 154(b) by 0 days.

(21) Appl. No.: 11/854,930

(22) Filed: Sep. 13, 2007

(65) Prior Publication Data

US 2008/0000845 A1 Jan. 3, 2008

Related U.S. Application Data

(63) Continuation-in-part of application No. 11/138,947, filed on May 26, 2005, now Pat. No. 7,276,156.

(51) Int. Cl.
*E03F 5/14* (2006.01)

(52) U.S. Cl. ..... 210/747; 210/767; 210/155; 210/163; 210/170.03; 210/434

(58) Field of Classification Search ..... 210/747, 210/767, 155, 162, 163, 164, 170.03, 323.1, 210/434

See application file for complete search history.

(56) References Cited

U.S. PATENT DOCUMENTS 316,578 A 4/1885 Schumann
770,019 A * 9/1904 Neireiter ..... 210/163
1,693,977 A 12/1928 Egan
2,986,232 A 5/1961 Wiley
3,945,746 A 3/1976 Bredbenner
4,689,145 A 8/1987 Mathews et al.
4,793,728 A 12/1988 Ellis
5,133,619 A 7/1992 Murfae et al.
5,232,587 A 8/1993 Hegemier et al.
5,405,539 A 4/1995 Schneider
5,409,602 A 4/1995 Sorenson
5,480,254 A 1/1996 Autry et al.
5,643,445 A * 7/1997 Billias et al. ..... 210/162
5,736,035 A 4/1998 Nurse
5,744,048 A 4/1998 Stetler
5,820,762 A 10/1998 Bamer et al.
5,849,198 A 12/1998 Sharpless
5,855,774 A 1/1999 Boelter
5,904,842 A 5/1999 Billias et al.
5,980,740 A 11/1999 Harms et al.
5,980,744 A 11/1999 Gagnon et al.
5,985,157 A 11/1999 Leckner et al.
6,051,131 A 4/2000 Maxon
6,080,307 A 6/2000 Morris et al.
6,093,314 A 7/2000 Wilson et al.
6,106,707 A 8/2000 Morris et al.

(Continued)

*Primary Examiner*—Christopher Upton
(74) *Attorney, Agent, or Firm*—Coats & Bennett, P.L.L.C.

(57) ABSTRACT

A filter for use in a storm water drain to prevent debris from reaching the outlet of the drain. The filter is adjustable to be sized for a range of flow capacities. The filter includes a main filter section having openings through which water flows. A pair of adjustable side grates project from the main filter section and are adaptive to be connected to the sidewall of a storm drain. Flow capacity of the filter can be varied by adjusting the effective width of the respective side grates.

24 Claims, 8 Drawing Sheets

U.S. PATENT DOCUMENTS

| | | | | |
|---|---|---|---|---|
| 6,126,817 | A | 10/2000 | Duran et al. | |
| 6,149,803 | A * | 11/2000 | DiLoreto et al. | 210/164 |
| 6,193,880 | B1 * | 2/2001 | Bergeron | 210/162 |
| 6,200,484 | B1 | 3/2001 | McInnis | |
| 6,214,216 | B1 * | 4/2001 | Isaacson | 210/162 |
| 6,214,217 | B1 | 4/2001 | Sliger | |
| 6,217,757 | B1 | 4/2001 | Fleischmann | |
| 6,231,758 | B1 | 5/2001 | Morris et al. | |
| 6,270,663 | B1 | 8/2001 | Happel | |
| 6,428,692 | B2 | 8/2002 | Happel | |
| 6,531,059 | B1 | 3/2003 | Morris et al. | |
| 6,537,446 | B1 | 3/2003 | Sanguinetti | |
| 6,537,447 | B2 * | 3/2003 | Remon | 210/163 |
| 6,554,997 | B1 * | 4/2003 | Schilling et al. | 210/164 |
| 6,749,746 | B2 | 6/2004 | Mokrzycki | |
| 6,797,162 | B2 | 9/2004 | Happel | |
| 6,869,526 | B2 | 3/2005 | Sharpless | |
| 2003/0127380 | A1 | 7/2003 | Morris et al. | |
| 2004/0164026 | A1 | 7/2004 | Manzone | |
| 2004/0226869 | A1 | 11/2004 | McClure et al. | |

* cited by examiner

STORM DRAIN FILTER WITH VARIABLE FLOW CAPACITY

CROSS REFERENCE TO RELATED APPLICATION

The present application is a continuation-in-part of U.S. patent application Ser. No. 11/138,947 filed May 26, 2005, the disclosure of which is hereby expressly incorporated by reference.

FIELD OF THE INVENTION

The present invention relates to filters for storm drains, and more particularly to adapting a storm drain filter to provide variable flow capacity.

BACKGROUND OF THE INVENTION

In order for a storm drain filter to be effective it must provide ample flow capacity to handle storm water flow and prevent debris passage. Some storm drain filters are adequate in terms of flow capacity for certain installations while in others a greater flow capacity is required. It is costly to produce various different storm drain filters for various required flow capacities.

Therefore, there is a need to provide an effective way of adapting a single storm drain filter so that the filter has adjustable flow capacity and can thus be effectively utilized under varying flow conditions.

SUMMARY OF THE INVENTION

The present invention entails a filter for a storm drain. The filter comprises a main filter section for placing adjacent to a storm drain outlet to prevent debris from entering the outlet and to permit water to flow into the outlet. At least one variable width grate connects to the main filter section. By varying the width of the variable width grate the flow capacity of the filter can be varied.

Also disclosed is a method of filtering debris in a storm water drain. The method includes placing a filter in a storm drain and interposing the filter between an inlet of the storm water drain and an outlet of the storm water drain. Flow capacity of the filter is adjusted by increasing or decreasing the effective width of the filter. In one embodiment, the filter includes a main filter section and at least one variable width grate that connects to the main filter section and extends therefrom.

Other objects and advantages of the present invention will become apparent and obvious from a study of the following description and the accompanying drawings which are merely illustrative of such invention.

BRIEF DESCRIPTION

With further reference to the drawings, the filter of the present invention is shown therein and indicated generally by the numeral 10. As will be discussed subsequently herein, filter 10 is designed to be installed in a storm drain indicated generally by the numeral 50 and shown schematically in FIGS. 4 and 5. Prior to describing the installation of the filter 10 within the storm drain 50, the filter itself will be described.

Figure 2:
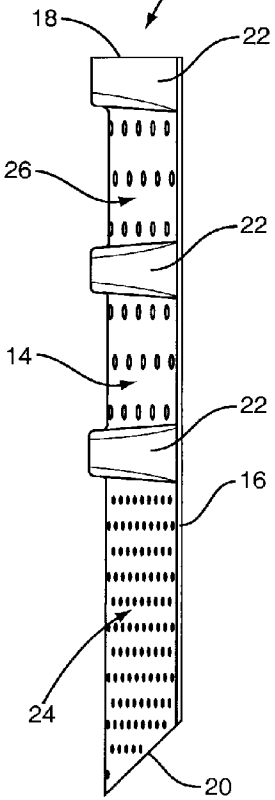
FIG. 2 is a side elevational view of the filter.
Figure 1:
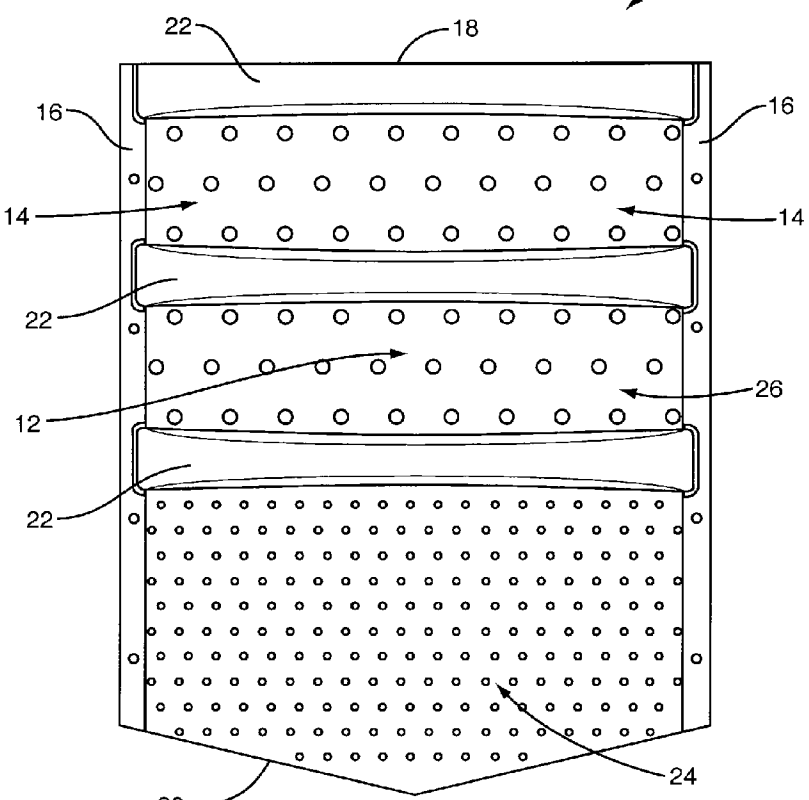
FIG. 1 is an elevational view of the filter of the present invention.
Figure 3:
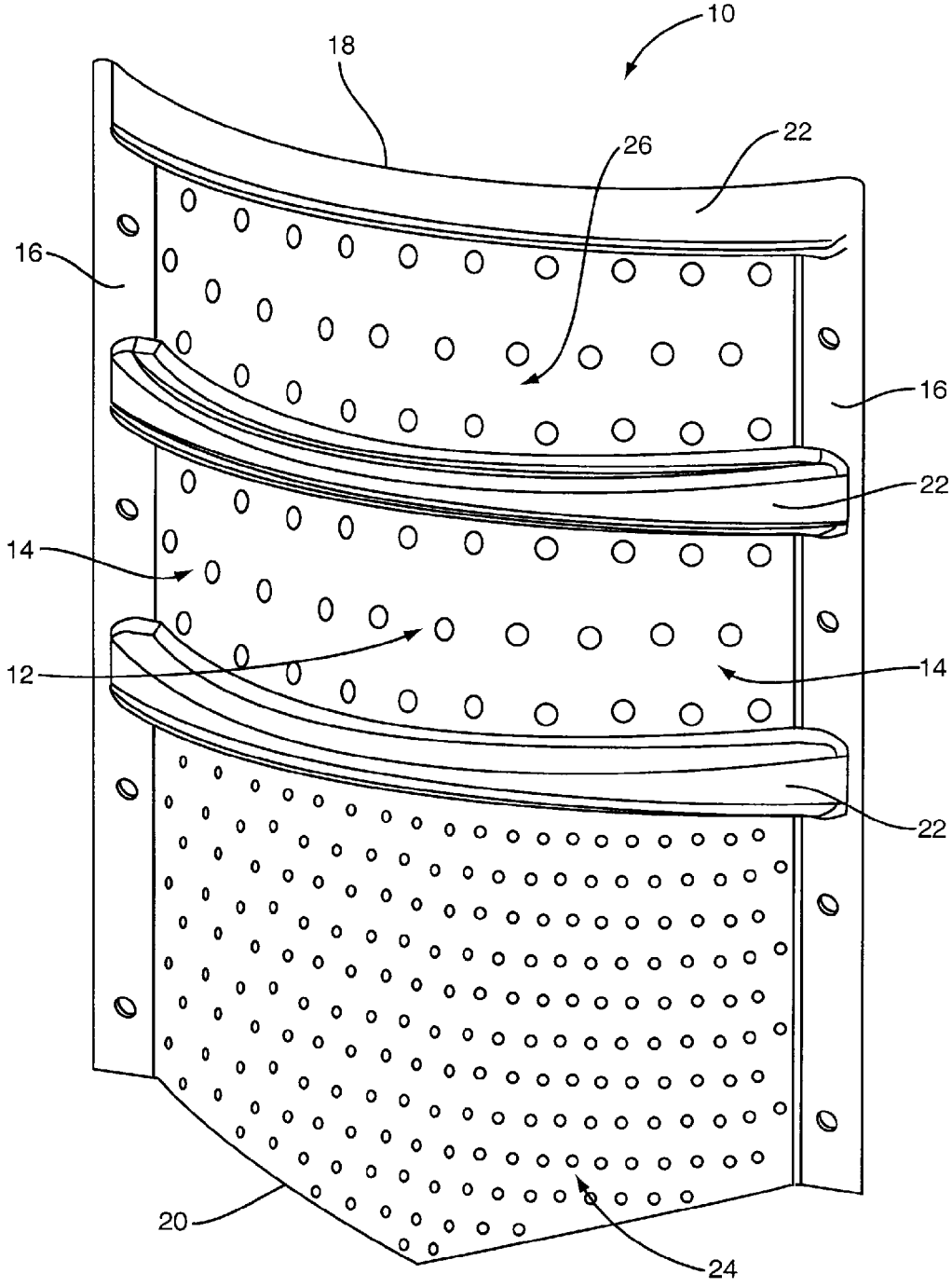
FIG. 3 is a perspective view of the filter.
Figure 4:
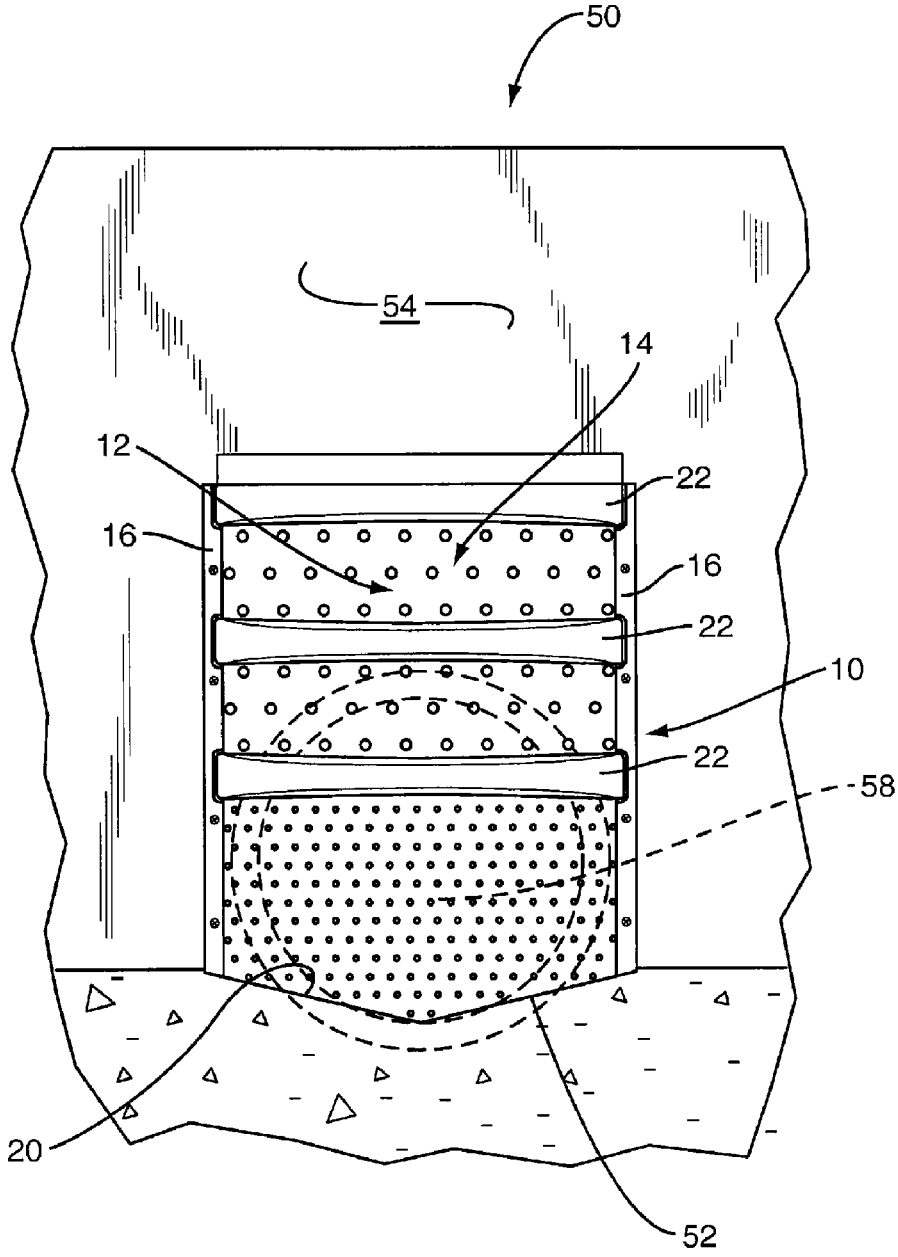
FIG. 4 is a fragmentary cross sectional view of a storm drain showing the filter of the present invention installed therein.
Figure 5:
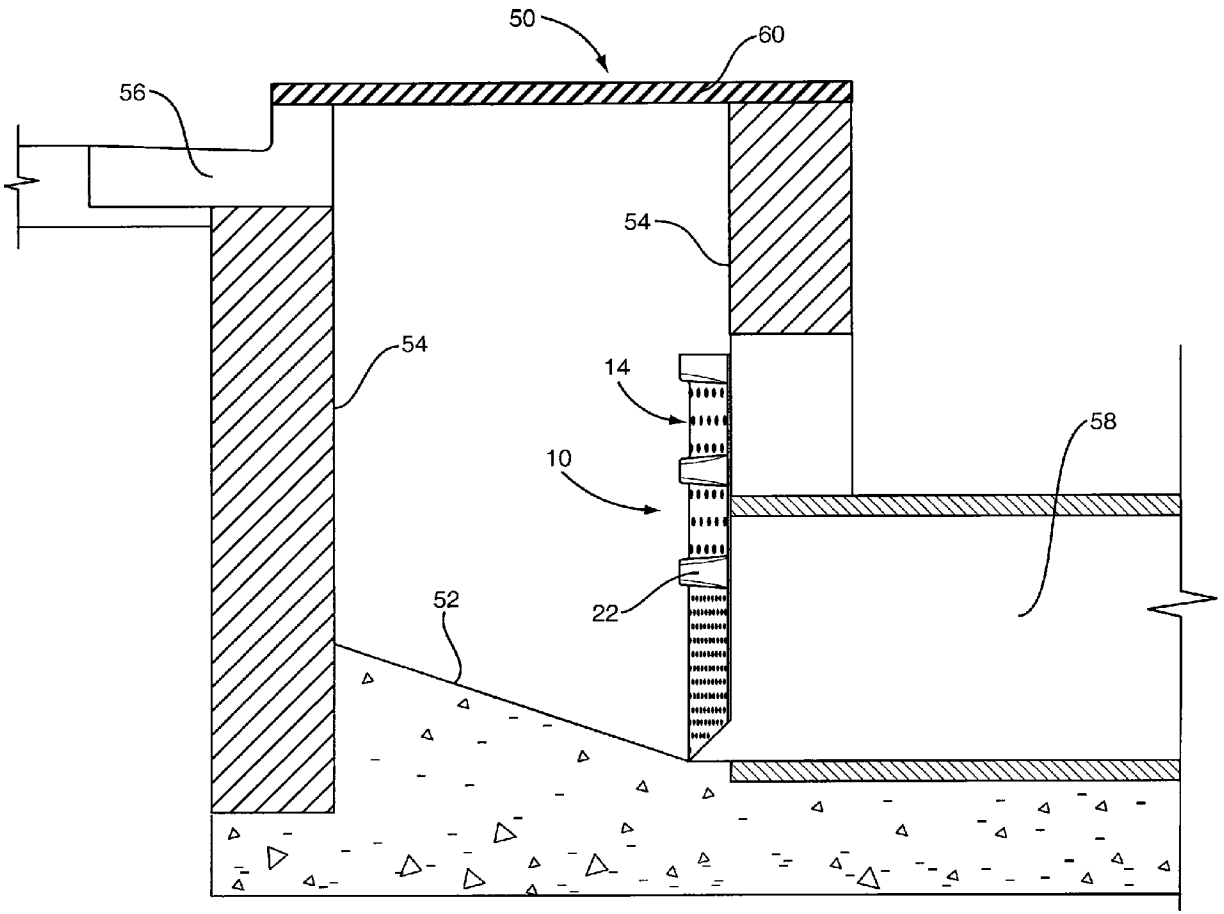
FIG. 5 is another cross sectional view of the storm drain showing the filter installed therein.

Viewing FIGS. 1-3, it is seen that the filter 10 assumes a generally curved or C-shape. Although filter 10, as shown in FIGS. 1-3, assumes a curved shape it should be appreciated that the basic shape could vary and could include various configurations such as a generally square C-shape. In any event, filter 10 is designed to be secured to a sidewall 54 of the storm drain 50. As seen in FIGS. 4 and 5, the filter 10 projects outwardly from the sidewall 54 and generally encompasses an area around an inlet 56 formed in the sidewall.

Filter 10 can be said to include a back portion or area 12 and a pair of opposed side portions 14. In the case of the embodiment shown in FIGS. 1-3, the back portion 12 and the side portions 14 form a continuous or integral construction due to the generally curved or C-shaped nature of the filter 10. However, it is appreciated, for example, that the back portion 12 and the side portions 14 could be disposed at an angle, such as a 90° angle, to each other. In any event, the filter 10 includes an open side that is designed to fit adjacent or directly to the sidewall 54 of the storm drain 50.

Disposed on each side of the filter 10 is a pair of flanges 16. In the case of the present embodiment, flanges 16 are generally flat and include an outwardly facing flat surface that abuts against the storm drain sidewall 54 when the filter 10 is installed therein. To secure the filter 10 within the storm drain 50 there is provided a series of openings in each of the flanges 16. Fasteners such as bolts or screws can be inserted through the openings into the adjacent sidewall 54 of the storm drain 50.

Filter 10 includes a series of transversely extending ribs 22. Ribs 22 extend between opposed flanges 16. In the case of the embodiment illustrated in FIGS. 1-3, there is provided three spaced apart ribs 22. However, it is appreciated that the number of ribs 22 can vary and that the filter 10 can be constructed without the incorporation of ribs.

Filter 10 includes a top 18 and a bottom 20. In the case of the particular design illustrated herein, the upper edge of the upper rib 22 forms the top edge 18. Bottom 20 in many embodiments will assume a non-linear configuration. This is because the bottom of storm drains will not be perfectly flat, especially in the area adjacent the outlet. This is because the bottoms of many storm drains are particularly configured to facilitate drainage towards the outlet. Thus, similar to that illustrated in FIGS. 4 and 5, the bottom of the storm drain can assume a V or trough shape adjacent the outlet 58. Accordingly, the bottom 20 of the filter 10 is normally formed or configured to conform to the bottom of the storm drain in the area where the filter 10 is to be positioned. That is, the bottom 20 of the filter 10 is designed to set flush against the bottom of the storm drain adjacent the site of the outlet.

In order to permit water to pass through the filter 10, as shown in FIGS. 1-3, the filter 10 is provided with a multiplicity of openings. In the case of the design illustrated herein, there is provided two sets of openings, a first set indicated generally by the numeral 24 and the second set indicated generally by the numeral 26. The first set of openings 24 is disposed about a lower portion of the filter 10 while the second set of openings 26 is disposed about an upper portion of the filter 10. The size of the openings of the first set 24 is smaller than the size of the openings comprising the second set 26 and disposed about the upper portion of the filter 10. Although the size, spacing and general arrangement of these openings can vary, this design for the openings will prevent smaller objects from passing through the filter 10 about the lower portion of the filter.

Turning particularly to FIGS. 4 and 5, there is shown therein a storm drain indicated generally by the numeral 50. Storm drain 50 includes a bottom 52 and a top 60. Extending upwardly from the bottom 52 around the storm drain 50 is a sidewall 54. About an upper portion of the storm drain 50 there is formed an inlet 56. Additionally, about a lower portion of the storm drain 50 there is an outlet 58. The outlet 58 can assume various forms. In one embodiment, the outlet 58 would include a pipe that extends from one area of the sidewall 54. In conventional fashion, outlet 58 channels or directs water from the storm drain 50 downstream therefrom.

As shown in FIGS. 4 and 5, filter 10 is disposed closely adjacent the sidewall 54 in the area of the outlet 58. That is, the flanges 16 are disposed flush against the sidewall 54 and a series of fasteners extend through openings in the flanges and into the sidewall 54 to secure the filter 10 in place. Note in FIG. 4 that the bottom 52 of the storm drain 50 assumes a generally trough or V-shape adjacent the outlet 58. This, of course, facilitates the movement of water from the storm drain 50 into the outlet 58. In any event, the bottom edge 20 of the filter 10 is particularly cut or formed to conform to the shape of the bottom 52 in this area. Hence, the filter 10 can fit flush against the bottom.

The open face of the filter 10 generally lies in the plane of the flanges 16 and the flanges are generally coplanar. Thus, the back portion 12 of the filter is disposed relatively close to the sidewall 54 of the storm drain. Essentially there is a space defined between the sidewall 54 and the filter 10. Thus, it is appreciated that trash, debris and other undesirable objects are filtered by the filter 10 prior to these unwanted objects and materials entering the outlet 58. Thus, over a period of time, trash, debris and other unwanted objects will accumulate exteriorly of the filter 10. Therefore, from time to time it may be appropriate for the storm drain 50 to be cleaned. The filter 10, when installed in this manner, will prevent trash, debris and other unwanted objects and materials from passing through the storm drain 50 into the outlet 58.

Another embodiment for the storm drain filter is shown in FIGS. 6-9. In this embodiment filter 10 comprises a main filter section 30 and a pair of variable width grates 40. Each variable width grate 40 is adapted to connect to and extend from opposite ends of the main filter section 30. As will be appreciated from subsequent portions of this disclosure, the width of each variable grate 40 can be varied and this effectively enables the flow capacity of the filter 10 to be varied. When filter 10 is deployed in a storm drain, each of the variable width grates 40 span an area or gap 41 that exists between the main filter section 30 and the sidewall 54 of the storm drain. Openings 42 provided in the variable width grate 40 permit storm water to flow through the grate. Openings 42, formed in each of the grates 40, are sized to substantially prevent movement of debris through the grate.

Main filter section 30 includes a sloped top 32 capping an upper portion of the main filter section. Top 32 prevents overflow of storm water and/or debris into the outlet 58 of the drain without passing through main filter section 30. Top 32 is generally sloped downward from the back to the front portion. A third set of openings or voids 28 is included in an upper portion of main filter section 30 immediately adjacent top 32 and above openings 26. Openings 28 are substantially larger than openings 26 and may be provided to allow limited overflow to accommodate surge conditions. Additionally, openings 28 provide access to the area between filter 10 and outlet 58 for inspection and cleaning while the filter is installed in storm drain 50.

In one embodiment, each variable width grate 40 comprises a series of spaced apart rods 44 and a support or mounting strip 48. The mounting strip 48 includes a series of spaced apart openings for receiving an end portion of the rods 44. Main filter section 30 includes a pair of end or side flanges 16. Each flange 16 includes a series of rod openings for receiving the opposite ends of the rods 44. Thus, as seen in the drawings, when the filter 10 is installed in a storm drain, the rods 44 are supported in the supports or strips 48 on one end, and supported on the other end by the rod openings in flange 16 of the main filter section 30. The rods may be formed of various materials amenable to use in storm water drains. In one embodiment the rods 44 are formed of a polymeric material such as, for example, nylon rods.

To position main filter section 30 at a selected distance D from sidewall 54, retainers connect between rods 44 and flanges 16. In one embodiment the retainers comprise locking collars 46 disposed on rods 44 and abutting flanges 16. Each locking collar 46 is adapted to snugly fit onto rod 44 to resist being moved along the length of the rod. In one embodiment, locking collars 46 comprise steel washers 46A having a compliant washer 46B bonded thereto. See FIG. 8. Steel washer 46A may be flat or bowled. Compliant washer 46B is sized to provide an interference or friction fit on rod 44.

At least one locking collar 46 is disposed on each rod 44 between one flange 16 and support 48, thereby defining a gap 41 between main filter section 30 and sidewall 54. Similarly disposing a locking collar 46 on each of the rods 44 extending from supports 48 provides a stable mounting plane to align main filter section 30 at a selected distance from sidewall 54. These locking collars 46 are referred to as inner locking collars. Main filter section 30 is positioned such that rods 44 extend through aligned openings in flanges 16 and the flanges abut the inner locking collars 46. Additional locking collars 46 may be placed over the ends of the rods 44 to further stabilize the filter section 30 in the selected position. These latter locking collars 46 are referred to as outer locking collars To more firmly secure main filter section 30 in place, one or more fasteners may be used to prevent the main filter section from backing off the sidewall 54 beyond the selected distance D in events where the locking capacity of locking collars 46 is exceeded. In one embodiment, the fasteners comprise threaded bolts 49. Threaded bolts 49 extend through openings in the supports 48 and are threaded into threaded inserts 49A embedded in the concrete sidewall 54. Thus engaged, bolts 49 secure the main filter section 30 and prevent movement of the main filter section farther away from sidewall 54.

Figure 7:
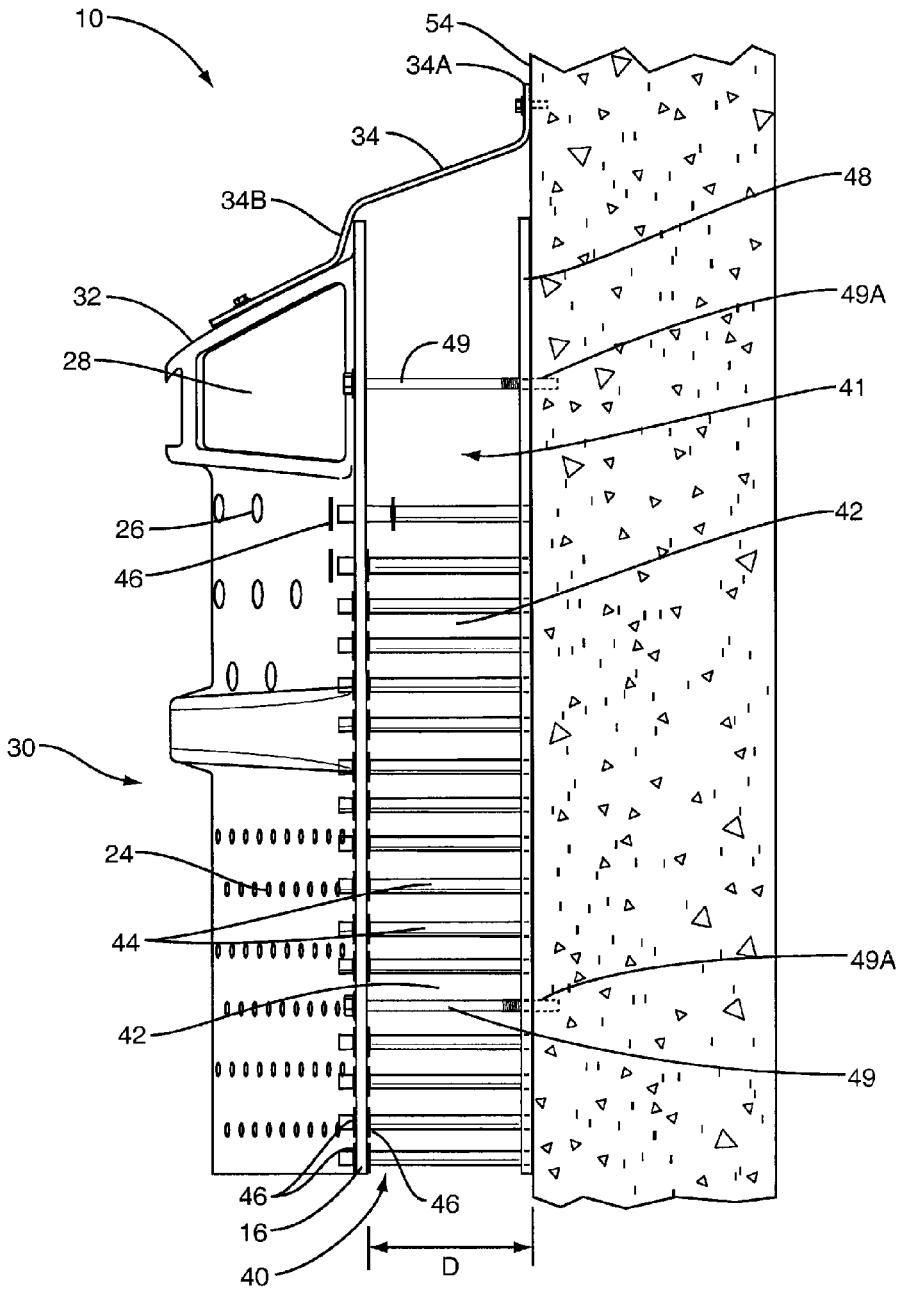
FIG. 7 is a side elevation view of the filter of FIG. 4 installed in a storm drain.
Figure 8:
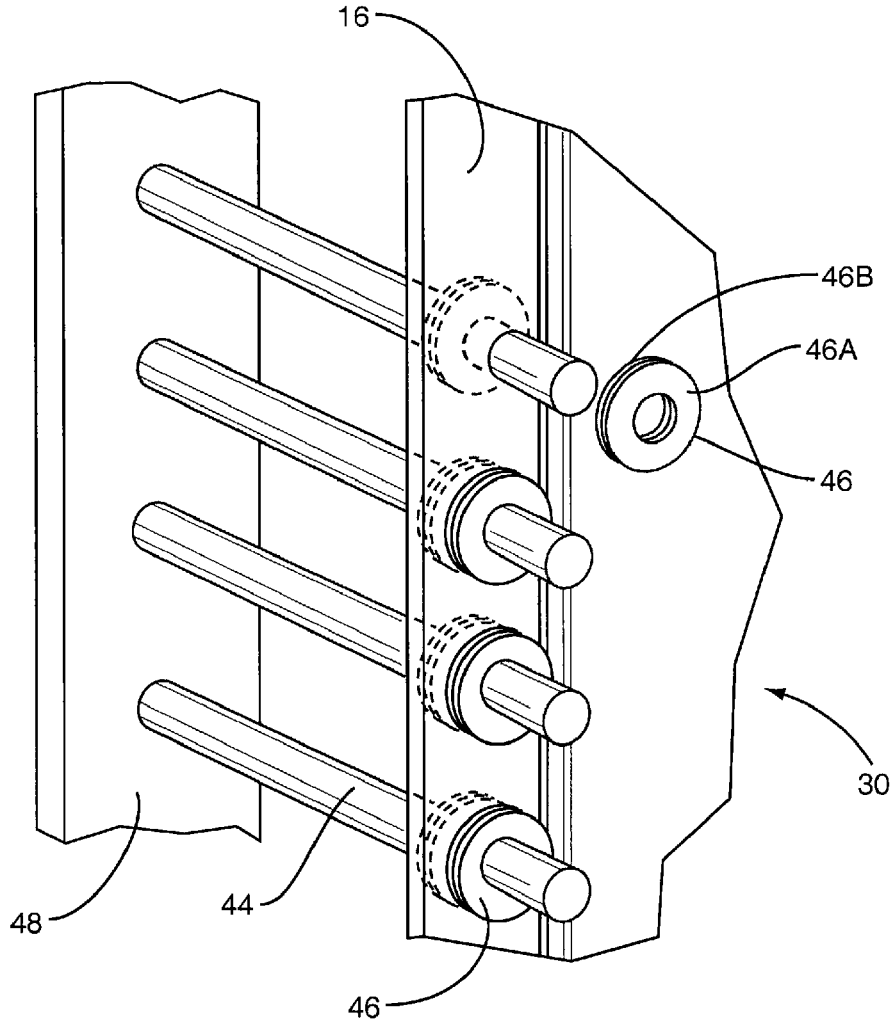
FIG. 8 is a fragmentary perspective view of the variable width grate.

As can be appreciated from FIG. 7, when installed variable width grates 40 include grated side openings comprised of rods 44 and openings 42 through which storm water flows. In the illustrated embodiment spaced rods 44 from a grill or grated arrangement that substantially prevents debris from reaching the outlet 58 and provides additional flow capacity to filter 10.

As mentioned above, main filter section 30 includes a slope top 32. In some cases, when installed in a storm drain, inflowing water and debris will impact the top portion of the filter 10. In these cases, the slope top 32 tends to deflect the water and debris away from the outlet 58.

Figure 9:
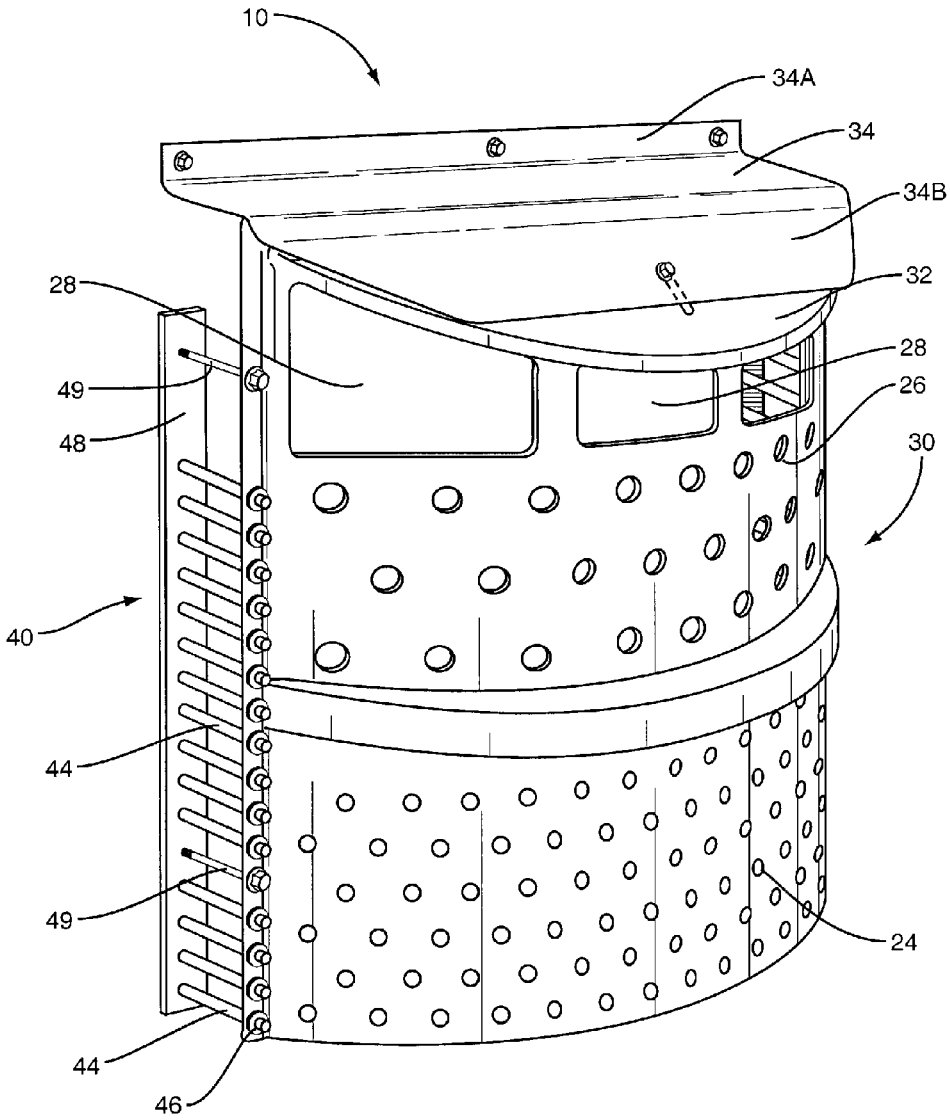
FIG. 9 is a perspective view of an installed filter including the variable width grate and a top flashing.

Furthermore, in some cases, the main filter section 30 will be used with one or both of the variable grates 40. When the main filter section 30 is used with one or both variable grates 40, the main filter section 30 will generally be spaced outwardly from the sidewall 54. See FIG. 7. To close the top of the filter 10, there is provided a flashing 34. Flashing 34 is secured to the sidewall 54 and overlaps a portion of the slope top 32, as illustrated in FIGS. 7 and 9. In one embodiment, flashing 34 comprises a bent metal sheet having a wall mount portion 34A angled relative to an overlapping portion 34B. Wall mount portion 34A of the flashing 34 may be secured to the sidewall 54 by various conventional means, such as masonry screws for example. Overlapping portion 34B extends over at least a portion of the slope top 32 and can be secured thereto with a bolt or other type of fastener. In one embodiment the overlapping portion 34B slidably contacts the slop top 32 such that the flashing 34 is permitted to slide against the slope top of the main filter section 30.

Figure 6:
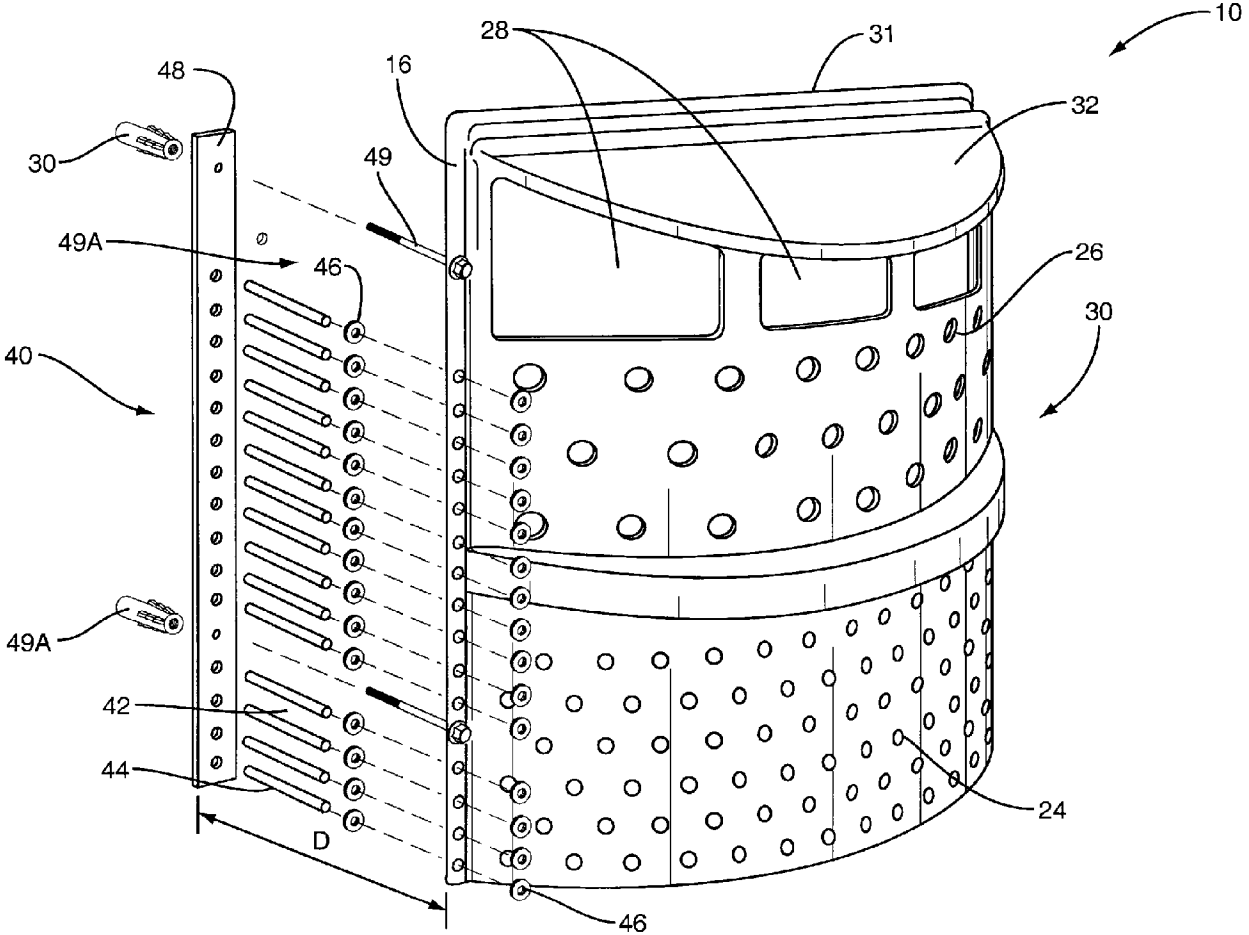
FIG. 6 is an exploded perspective view of an alternative design for the filter and shows a main filter section and a pair of variable width grates extending from the main filter section.

From the foregoing it is appreciated that the filter 10 can be configured to yield various flow capacities. For example, the filter 10 can be configured for a particular flow capacity by utilizing the two variable width grates 40. Each variable width grate 40 is effectively coupled to a flange 16 of the main filter section 30. Thus, the entire filter 10 comprises the main filter section 30 and the pair of variable width grates 40. The flow capacity of the filter 10 can be more particularly varied by adjusting the rods 44 with respect to a respective flange 16. That is, the main filter section 10 can be positioned at various distances with respect to the support 48. This effectively varies D, as illustrated in FIG. 6.

As discussed above, the individual rods 44 are supported at one end by openings in the support 48 and at the other end by openings formed in the respective flange 16 of the main filter section. Each rod 44 can be generally fixed with respect to the flange 16 by positioning opposing collars 46 as illustrated in FIG. 7. The inner collars 46 tend to prevent the rods 44 from being dislodged from the openings in the supports 48. The outer collars 46, on the other hand, cooperate with the inner collars to station the rods 44 with respect to the flange 16. Again, to secure the main filter section 30 in place, the elongated bolts 49 prevent the main filter section 30 from moving right to left, from the sidewall 54, as viewed in FIG. 7.

To adjust the flow capacity of filter 10 after installation, main filter section 30 may be moved inwards or outwards by applying forces sufficient to overcome the friction of locking collars 46 to reposition the main filter section 30 to a different spacing D from sidewall 54. Locking collars 46 are then re-snugged against flanges 16. It may be required to loosen or tighten bolts 49 or to replace the bolts with bolts of a different length, depending on the amount of the adjustment.

The present invention may, of course, be carried out in other specific ways than those herein set forth without departing from the scope and the essential characteristics of the invention. The present embodiments are therefore to be construed in all aspects as illustrative and not restrictive and all changes coming within the meaning and equivalency range of the appended claims are intended to be embraced therein.

The invention claimed is:

1. A storm drain filter for a storm drain comprising:

a. a main filter section having a series of openings formed therein and adapted to be placed in a storm drain adjacent a storm drain outlet for preventing debris from entering the outlet while permitting water to flow through the main filter section;

b. a variable width grate extending from the main filter section wherein the width of the grate is adjustable so as to vary the flow capacity of the filter; and c. wherein the variable width grate includes a series of rods adapted to extend from a sidewall of the storm drain, and wherein the rods project through rod openings formed in the main filter section.

2. The storm drain filter of claim 1 including a pair of variable width grates, one variable width grate extending from one portion of the main filter section and another variable width grate extending from another portion of the main filter section, and wherein each variable width grate is variable in width in order to vary the flow capacity of the filter.

3. The storm drain filter of claim 2 wherein each variable width grate extends from a side of the main filter section, and wherein the main filter section and the pair of variable width grates form a generally C-shaped configuration.

4. The storm drain filter of claim 1 wherein the rods permit the main filter section to be moved with respect to the rods so as to vary the distance between the sidewall of the storm drain and the main filter section.

5. The storm drain filter of claim 1 wherein the main filter section comprises a molded piece of plastic material having the openings formed therein, and wherein the variable width grate is a separate structure attachable to the main filter section.

6. The storm drain filter of claim 1 wherein the variable width grate includes a plurality of fasteners for securing the plurality of rods to the main filter section.

7. The storm drain filter of claim 6 wherein the variable width grate includes a rod supporting strip spaced from the main filter section, and wherein the plurality of rods extend between the supporting strip and the main filter section.

8. The storm drain filter of claim 7 wherein the main filter section includes a flange having the openings for receiving the rods formed therein such that the rods extend between the supporting strip and the openings formed in the flange of the main filter section.

9. The storm drain filter of claim 1 including a pair of variable width grates extending from opposite areas of the main filter section, each variable width grate including a support having a series of spaced apart openings and adapted to be disposed adjacent the sidewall of the storm drain, the plurality of rods extending between the openings in the support and openings formed in the main filter section, and a series of fasteners for securing the rods.

10. The storm drain filter of claim 9 wherein the main filter section includes a pair of flanges and wherein the openings for receiving the rods are formed in the flanges of the main filter section.

11. The storm drain filter of claim 1 wherein the main filter section is formed of a single piece of molded plastic and assumes a generally C-shaped configuration and includes a sloped top that slopes from a back portion of the main filter section towards the front portion of the main filter section.

12. The storm drain filter of claim 11 including a flashing adapted to overlie at least a portion of the sloped top of the main filter section and to be attached to the storm drain.

13. The storm drain filter of claim 1 further comprising a storm drain having a sidewall with the outlet disposed in the sidewall, and wherein the main filter section and the variable width grate extends around an area in front of the outlet and wherein at least a portion of the storm drain filter abuts against the sidewall of the storm drain so as to form an enclosed area in front of the outlet.

14. The storm drain filter and storm drain of claim 13 wherein the storm drain filter includes a pair of variable width grates, one variable width grate extending from one portion of the main filter section and another variable width grate extending from another portion of the main filter section, and wherein each variable width grate abuts against the sidewall.

15. The storm drain filter and storm drain of claim 14 wherein the main filter section comprises a single piece of molded plastic, and wherein each of the variable width grates are disposed adjacent to the main filter section.

16. A method of filtering debris in a storm water drain comprising:

a. placing a filter in the storm water drain and interposing the filter between an inlet of the storm water drain and an outlet of the storm water drain;

b. adjusting the flow capacity of the filter by increasing or decreasing the effective width of the filter in the storm drain; and c. wherein the variable width grate includes a series of generally horizontal rods and wherein the rods are adjustable with respect to the main filter section such that the rods can be moved through openings in the main filter section and positioned at different locations with respect to the main filter section.

17. The method of claim 16 wherein the filter includes a main section and a variable width grate that extends from the main section, and the method includes varying the width of the variable width grate to adjust the flow capacity of the filter.

18. The method of claim 16 wherein the outlet is disposed in a sidewall of the storm drain, and the method including positioning the filter in the storm drain such that opposite ends of the filter abut the sidewall and the filter encompasses an area generally adjacent the outlet; the method further including expanding or contracting the filter such that the effective area of the filter is increased or decreased, thereby adjusting the flow capacity of the filter.

19. A filter for a storm drain comprising:

a. a main filter section for placement adjacent a storm drain outlet to prevent debris from entering the outlet and to permit water to flow into the outlet;

b. a mounting structure for connecting the main filter section to a sidewall of a storm drain to secure the main filter section adjacent the storm drain outlet;

c. the mounting structure further adapted to permit storm water to flow therethrough from a storm drain inlet to the outlet and to prevent debris from entering the outlet; and d. the mounting structure adapted to offset the main filter section from the sidewall at variable distances to enable variable flow capacity for the filter.

20. The storm drain filter of claim 19 wherein the mounting structure comprises a pair of connecting strips with each connecting strip including a series of rod openings, and wherein the mounting structure includes a series of rods; and wherein the main filter section includes two sets of rod openings formed therein; and when the filter is mounted in the storm drain, the strips are secured to the sidewall of the storm drain and the rods are supported on one end by the rod openings in the strips, and wherein the rods project therefrom into the two sets of rod openings formed in the main filter section such that the rods are supported in the rod openings formed in the main filter section, resulting in the main filter section being spaced from the sidewall but adjustable back and forth with respect to the sidewall on the rods; and a plurality of fasteners securable on the rods for securing the main filter section to the rods.

21. The storm drain filter of claim 19 wherein the mounting structure comprises: a pair of strips with each strip including a series of spaced apart openings and adapted to be secured adjacent the sidewall, a plurality of rods that extend between openings in the strips and openings formed in the main filter section; and a series of fasteners for securing the main filter section to the rods.

22. The storm drain filter of claim 21 wherein the openings formed in the main filter section are formed in a pair of opposed flanges that form a part of the main filter section.

23. The storm drain filter of claim 19 wherein the mounting structure includes a series of rods adapted to extend from the sidewall to engage a series of openings disposed on the main filter section.

24. A storm drain filter for a storm drain comprising:

a. a main filter section having a series of openings formed therein and adapted to be placed in a storm drain adjacent a storm drain outlet for preventing debris from entering the outlet while permitting water to flow through the main filter section;

b. a variable width grate extending from the main filter section wherein the width of the grate is adjustable so as to vary the flow capacity of the filter;

c. the main filter section formed of a single piece of molded plastic and assumes a generally C-shaped configuration and includes a sloped top that slopes from a back portion of the main filter section towards the front portion of the main filter section; and d. a flashing adapted to overlie at least a portion of the sloped top of the main filter section and to be attached to the storm drain.

* * * * *